US006660968B1

(12) United States Patent
Mottelet et al.

(10) Patent No.: US 6,660,968 B1
(45) Date of Patent: Dec. 9, 2003

(54) HEATED GLASS PANES, IN PARTICULAR FOR VEHICLES

(75) Inventors: Beatrice Mottelet, Compiegne (FR); Bernard Letemps, Thourotte (FR)

(73) Assignee: Saint-Gobain Glass France, Courbevoie (FR)

( * ) Notice: Subject to any disclaimer, the term of this patent is extended or adjusted under 35 U.S.C. 154(b) by 0 days.

(21) Appl. No.: 09/959,564

(22) PCT Filed: Apr. 28, 2000

(86) PCT No.: PCT/FR00/01173

§ 371 (c)(1),
(2), (4) Date: Jan. 18, 2002

(87) PCT Pub. No.: WO00/67530

PCT Pub. Date: Nov. 9, 2000

(30) Foreign Application Priority Data

Apr. 30, 1999 (FR) ..... 99 05520

(51) Int. Cl.[7] ..... H05B 3/84

(52) U.S. Cl. ..... 219/203; 52/171.2; 219/522; 219/486

(58) Field of Search ..... 219/203, 522, 219/510, 486, 480, 202; 52/171.2

(56) References Cited

U.S. PATENT DOCUMENTS

| | | | | |
|---|---|---|---|---|
| 3,475,588 A | * | 10/1969 | McMaster | 219/203 |
| 3,982,092 A | | 9/1976 | Marriott | |
| 4,277,672 A | * | 7/1981 | Jones | 219/497 |
| 5,057,666 A | * | 10/1991 | Takada | 219/203 |
| 5,182,431 A | * | 1/1993 | Koontz et al. | 219/203 |
| 5,496,989 A | | 3/1996 | Bradford et al. | |
| 6,163,013 A | * | 12/2000 | King et al. | 219/203 |

FOREIGN PATENT DOCUMENTS

| | | | |
|---|---|---|---|
| CA | 2079175 | * | 4/1993 |
| DE | 38 28 526 | | 3/1990 |
| FR | 2728514 | * | 6/1996 |
| GB | 2 042 859 | | 9/1980 |
| GB | 2 186 769 | | 8/1987 |
| JP | 4-5151 | * | 1/1992 |

* cited by examiner

*Primary Examiner*—John A. Jeffery
(74) *Attorney, Agent, or Firm*—Oblon, Spivak, McClelland, Maier & Neustadt, P.C.

(57) ABSTRACT

A glass pane including at least a glass sheet provided with heating strips powered by collectors, the heating strips being divided in groups. The power supply of the different groups is provided sequentially, each group being powered once per sequence. The supply is provided by a device equipped to measure the outside temperature and the temperature of the outer surface of the glass, to determine a minimum heating time for each group according to the outside temperature, and to maintain the heating in the group as long as the outer surface temperature of the glass opposite the group is not higher than the melting point of ice.

12 Claims, 2 Drawing Sheets

HEATED GLASS PANES, IN PARTICULAR FOR VEHICLES

BACKGROUND OF THE INVENTION

1. Field of the Invention

Figure 1A:
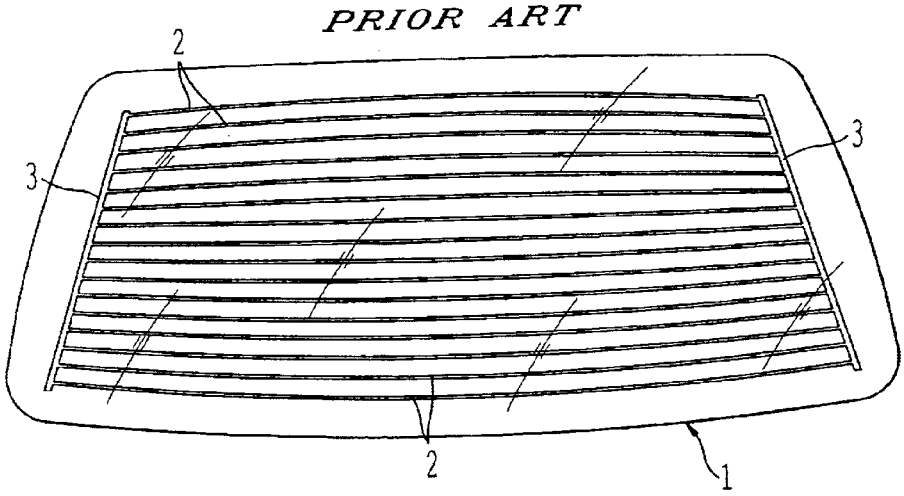
FIG. 1A PRIOR ART

The present invention concerns an electrically heated glass pane, in particular for a motor vehicle.

2. Discussion of Background

The heated glass panes used in motor vehicles are generally composed of at least a glass sheet provided on one of its faces with a heating network consisting of strips of resistance connected in parallel. This network generally enables the deicing or demisting of the glass pane. The strips of resistance may have a constant cross section, but it is also known to have their width vary from one end to the other of the glass pane in order to have intensified heating areas and preferential fields of view. In all these glass panes, the same nominal power is applied to all the resistance strips for the duration necessary for deicing or demisting the glass pane.

The heating network of such glass panes may also include several heating areas operating sequentially and in cycles (see U.S. Pat. No. 3,982,092). The heating of each area is controlled by means of a differential thermostat functioning over a narrow temperature range, for example 10 to 30° C. With this type of glass pane, we cannot, however, adapt the duration or power of heating to outside conditions such as temperature, the thickness of the ice or the amount of mist. What happens is that the first area is heated as soon as the outside temperature is less than the lower temperature (10° C.) of the thermostat, and the heating of this area stops, to pass on to the next area, only when the temperature reaches the upper temperature (30° C.) of the thermostat.

SUMMARY OF THE INVENTION

In the motor vehicle sector, the tendency is towards the multiplication of powered devices of all kinds (seat adjustment, door locks, electric windows, wing mirrors, etc.). For this purpose, we seek to reduce the energy consumption of electrically heated glass panes by reducing the power consumed or the duration of heating without affecting the efficiency of the deicing or demisting.

In order to achieve this one can, as it is disclosed in U.S. Pat. No. 5,496,986, provide the glass pane with an electronic device which permits to control the external temperature and to apply the minimal power necessary to heat the glass surface.

The purpose of the present invention is therefore to propose an economic heated glass pane, especially a heated glass pane that can be used advantageously as a rear window in a motor vehicle, said glass pane being used for demisting or efficient deicing with a reduced duration of heating and/or a gain in the power consumed.

This purpose is achieved by the glass pane according to the invention comprising at least a glass sheet provided with heating strips powered by collectors, the heating strips being divided in groups, the power supply to the different groups being provided sequentially, each group being powered once per sequence, the supply being provided by a device equipped with means enabling it to measure the outside temperature and the temperature of the outer surface of the glass, to determine a minimum heating time for each group according to said outside temperature, and to maintain the heating in said group as long as the outer surface temperature of the glass opposite said group is not higher than the melting point of ice.

The glass pane according to the invention is preferentially a motor vehicle rear window, but it can also be a windscreen or any other glass pane for the motor vehicle or a glass pane used in applications other than a motor vehicle. This glass pane may comprise one or more sheets of glass and possibly one or more plastic sheets. In most cases, it is a monolithic glass pane comprising a tempered sheet of glass or, possibly, it is a laminated glass pane comprising at least two sheets of glass generated by a plastic insert or an armored glass pane further comprising at least a sheet having the required armoring properties. The glass pane may also be convex. The heating strips are located on at least one face (and generally only on one face) of a sheet of glass the glass pane and/or, where appropriate, are located on or are embedded in a plastic insert of the glass pane.

The heating strips are generally electrically conductive transparent layers with a suitable resistance (generally in the region of 0.1 Ω and capable of going up to 200 Ω), for example a layer containing a metal oxide such as tin oxide, or are metal conductor wires of suitable resistivity, for example thin tungsten wires, or are wires with an electrically conductive composition (generally enamel) also with a suitable resistivity (i.e. generally in the region of a few $\mu\Omega$.cm, able to go up to 50 $\mu\Omega$.cm in the present invention). The conductive compositions used are generally in the form of a suspension of metallic silver and glass frit in an organic binder, and are generally deposited by screen printing or any other equivalent technique before being dried and baked at high temperature (for example during glass bending or tempering treatment) on the glass pane. Such wires may also be reinforced subsequently, by an electrolytic process or by metal deposition not using electrical current to achieve the resistance value wanted. Preferably screen-printed wires are used for glass panes formed of a tempered sheet of glass and for laminated glass panes, and tungsten wires are used for laminated glass panes.

The heating strips may be wavy or straight and are preferably narrow strips, for example approximately 10 mm in the motor vehicle sector and up to 100 mm for glass panes used in building for the conductive layers, in the region of 0.2 to 0.8 mm for screen-printed wires and in the region of 25 to 50 $\mu$m for tungsten wires. Also preferably, the strips are arranged with a gap between neighboring strips that may attain several centimeters. Advantageously, these strips are also arranged horizontally (generally along the larger dimension of the glass pane) in the position of use of the glass pane, especially for a rear window, and are isoresistant, i.e. they have constant resistivity over their whole length. For example, the strips are transparent layers or screen-printed wires uniform both in terms of conductive composition and thickness, or are metal wires of constant cross section.

The heating strips, at the two lateral edges of the glass pane, are connected by electrical connection elements to the current supply cables, these elements being called connectors or current supply terminals or collector strips or "busbars". In the present invention, these elements are referred to hereafter more simply as "collectors". These collectors may come, for example, in the form of metal strips or sections (for example in the form of tinned copper tabs) attached for example by welding onto the glass pane. Each separately powered group has its own collectors. These may be obtained by splitting the normal collecting strips into several parts separated by insulators or several collectors may be used, the number of collectors or separate parts in the collectors depending on the number of groups to be powered.

According to the definition of the invention, power is supplied sequentially, each group being powered by its own collectors and each group being powered only once per sequence. "Sequence" here is understood to mean the operation consisting in heating each group of heating strips just once in a specified order with a view to achieving the deicing and/or demisting of the glass pane. The sequential power supply of the groups is controlled by a device equipped with means for establishing the power supply sequence, i.e. the order in which the different groups are powered one after the other, and for determining the duration of heating of each of these groups. For this purpose, an electronic control box or a control device may be used connected to the collectors comprising means of measuring the outside temperature and the surface temperature of the glass, the control box or device being programmed to associate a heating time or minimum power supply time with each group according to the temperature measured, and which maintains the heating for as long as the ice remains (i.e. as long as the temperature of the outer surface of the glass with respect to the heating group is less than the melting temperature of ice). In general, the melting temperature is equal to the melting point of ice measured under normal conditions (0° C.) but it may vary considerably according to altitude and the purity of the water. The minimum heating time depends on several parameters such as the nature of the glass pane (dimensions, number of heating groups, number and nature of heating strips, etc.) and the nature of the deposit (ice, mist). In the case of deicing and for a given glass pane, the minimum heating time for a given outside temperature (in general negative) is determined experimentally by measuring the time during which it is necessary to heat each group to completely remove a layer of ice of given characteristics. Once programmed, the electronic box or control device associates a minimum heating time with the measured temperature for each group and maintains the heating for as long as the surface temperature of the glass is less than the reference value. To determine the various temperatures, any kind of suitable instrument may be used, for example a temperature sensor. The outside temperature sensor may be placed anywhere on the vehicle, so long as it is away from a source of heat or exposure to the sun's rays, for example under the hood of a motor vehicle. The glass surface temperature sensor may be placed on the outer face or the inner face of the glass pane, it is generally placed close to the power supply collector, basically for reasons of ease of use and cost. In preference, each heating group is provided with a glass surface temperature sensor. Generally and in preference, the glass surface temperature sensor is placed on the inner face of the glass pane (in order to avoid any protrusion on the outer surface), which requires adjusting the reference value chosen or the value measured by the sensor by applying a suitable adjustment factor to the glass pane in question.

In an especially preferred way, the glass pane is equipped with an electronic control box or a collector control device, this box or device being connected to a sensor for measuring the outside temperature and with as many glass surface temperature measuring sensors as heating groups, each heating group only being connected to a single glass surface temperature sensor.

Deicing or demisting may be activated manually, the outside temperature sensor measuring the temperature at the moment when the deicing is activated. According to the temperature measured, the first heating group is powered for the duration corresponding to the time of minimum heating, or according to the measured temperature of the glass surface, then the next group is powered. When the last group has been heated, the power supply is switched off or, where necessary, a new sequence is initiated. In general, a single sequence is sufficient to reach a satisfactory level of deicing or demisting.

Deicing or demisting may also be automatic and free of any manual starting, the control box or device being for example programmed to maintain visibility in case of ice or mist, this also having an advantage in terms of convenience and saving current. The glass pane may include, for example in series, on its power supply circuit, a device conducting current when it is covered with ice or mist and switching the power supply current off when the ice or mist has disappeared, for example an electronic device including at least a power transistor. It may further include a special antimist device and other detector(s) sensitive to atmospheric conditions (mist, moisture detector, systems of electrodes, heat detector or sensor, etc.) placed for example on the inner face of the glass pane, this (these) detector(s) controlling a heating band power supply sequence. A threshold (3° C. for example) may also be set, above which deicing may not be started for safety reasons.

In preference, with the strips being placed horizontally, heating takes place starting with the group located in the upper part of the glass pane in the position of use so that the water flow occurring as a result of this heating contributes to the deicing of the lower parts. This does not, however, exclude starting with another group, for example with a median group (where appropriate) or with a lower group. The groups are powered one after the other according to the sequence chosen. Advantageously, only one group is powered at a time, each group only being powered once per sequence. The powering of a group or of several groups successively may possibly be restarted in the event of ice or mist reappearing, at the end of the sequence.

The particular structure and implementation of the glass pane according to the invention enable rapid deicing helping to improve driving safety, and are especially advantageous when the available electrical power is limited. In general, at the end of 2 to 6 minutes, the first group of strips, especially when it involves wires, is completely deiced whereas on existing glass panes, it requires something in the region of 12 minutes to have a preferential area deiced. Advantageously, for the same dissipated power, 30% deicing or demisting time is gained with glass panes according to the invention by comparison with existing glass panes working in a nonsequential way, or if the same deicing or demisting time is used, the average dissipated power is 30% less than that of these same glass panes. It should also be noted that the dissipated power is more constant whereas in existing glass panes it can vary by about 10% during operation. Another advantage is that it is not necessary to provide resistances with intensified heating areas (especially in the horizontal direction), for example by varying the composition or thickness of the layers, the width or the thickness of the screen-printed wires, or the cross section of the metal wires in the lesser heating areas, the production of such glass panes being clearly more complicated. Advantageously, the glass pane according to the invention may be provided with conductors with a constant cross section and thickness (even if using conductors with a variable cross section and/or thickness and/or composition is not ruled out) and may therefore be produced easily and economically.

Each group comprises one or more strips, preferably comprises from two to 10 heating strips, and in an especially preferred way comprises three to 7 heating strips, the heating strips being connected in parallel within each group. Each group has its own collectors and each collector powers a single group. The glass pane presents several heating areas (groups) in a vertical direction separate from one another and several separate power supply areas (one separate power supply per group), power being supplied area by area.

When the glass pane according to the invention is intended for motor vehicle use, the number of heating groups is preferably 3. Beyond 3 groups, the gain in power or deicing or demisting time is not significant.

For motor vehicle applications in particular, the electrical system powering the heating strips may operate at 12 Volts (as normally used in the motor vehicle sector) but in preference it operates at a higher voltage, for example at 24, 30 or 42 Volts or more (nominal voltage of the battery used), the use of a higher voltage having the advantage of enabling less energy consumption, improving the efficiency of the electrical system conducting the current to the heating strips (reduced line losses for the same power—in the region of 180 to 250 Watts for deicing or demisting a glass pane—these line losses reducing the efficiency of the electrical system) and preventing heating effects in this system, this increase also enabling the space requirement of said system to be reduced (thinner power supply wires, smaller power transistors for power supply and cutouts, more economic equipment) and facilitating its production.

In the case of using this higher voltage and in order to have the necessary power for deicing or demisting the glass pane without excessive heating, the resistance of the heating strips may advantageously be increased, for example by lengthening the heating strips by deviations (even if it means reducing the number of wires per group where necessary) and/or by reducing the cross section (thickness and/or width) of the strips and/or where necessary by reducing the tin oxide content in the composition of the layers or the metallic silver content in the composition of the screen-printed wires.

BRIEF DESCRIPTION OF THE DRAWING FIGURES

According to the preferred embodiment of the invention, the groups of heating strips are carried by the same glass pane. The scope of the invention does not, however, rule out distributing the groups over several separate glass panes, each glass pane preferably including at least two groups of heating strips.

Figure 1B:
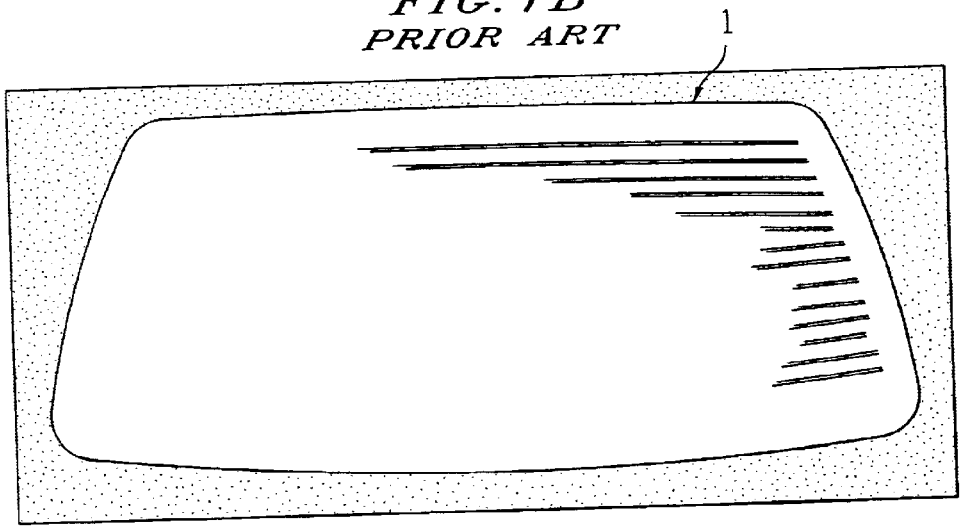
FIG. 1B PRIOR ART
Figure 2A:
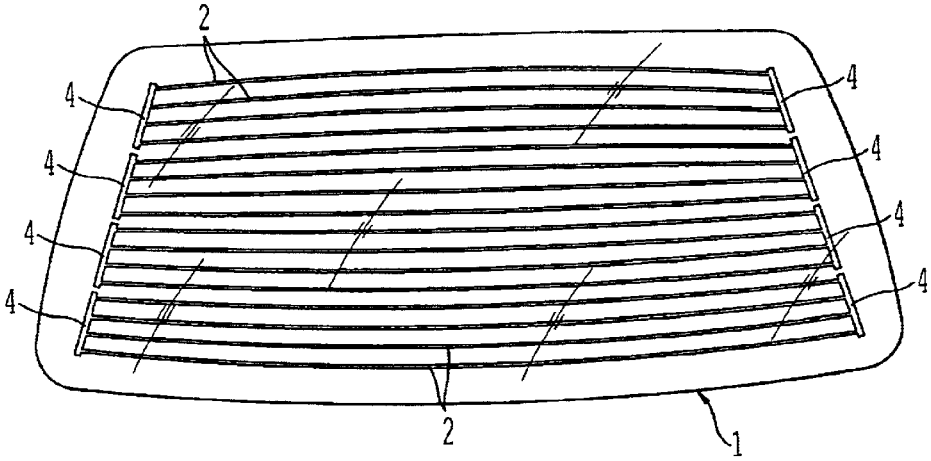
Figure 2B:
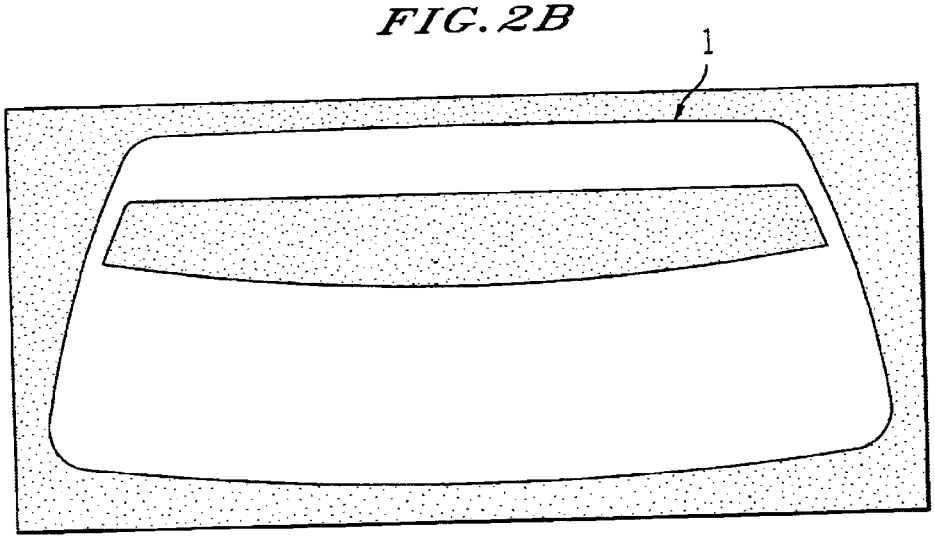

Other characteristics and advantages of the invention will emerge from the following examples according to the invention, given as a guide but not restrictive, in relation to comparative examples, these examples being illustrated by the following figures:

FIG. 1A: diagrammatic representation of a heated glass pane according to the prior art (comparative example 1);

FIG. 1B: photograph of a glass pane as illustrated in FIG. 1A, when in use, after a deicing time of four minutes;

FIG. 2A: diagrammatic representation of a heated glass pane according to the invention (example 1);

FIG. 2B: photograph of a glass pane as illustrated in FIG. 2A, when in use, after a deicing time of four minutes.

DETAILED DESCRIPTION OF THE PREFERRED EMBODIMENT

COMPARATIVE EXAMPLE 1

In this example and as illustrated in FIG. 1A, a glass pane 1 is used, for example a rear window, provided with 16 heating strips 2 connected to common collectors 3. The wires are connected in parallel. The supply voltage is 12 V.

As can be seen in FIG. 1B, the deicing observed at the end of four minutes is very little, the time needed to enable the beginning of vision through the glass pane being at least 8 minutes.

EXAMPLE 1

In this example according to the invention illustrated in FIG. 2A, a rear window 1 is used provided with 16 heating strips 2 connected in fours to separate power supplies 4. The four groups of four wires (these wires being connected in parallel in each group) are connected in series. The supply voltage is 12 V.

As seen in FIG. 2B, the deicing observed at the end of four minutes has already cleared a large viewing area.

COMPARATIVE EXAMPLE 2

The glass pane of comparative example 1 is used, modified in that it is provided with 21 heating strips (screen-printed wires).

A layer of ice is formed on this glass pane in the following manner: the glass pane is placed at −20° C. for at least 12 hours under controlled moisture conditions (low relative humidity), and 460 ml of water (that is, 660 ml/m$^2$) is sprayed onto the glass, the jet being positioned approximately 40 cm away and aligned perpendicularly to the surface.

The glass pane is stabilized for 4 hours at −20° C., and the heating strips are heated, the dissipated power being 210 W. It requires 10 minutes for starting to be able to see through the glass pane and 18 minutes for achieving complete deicing.

EXAMPLE 2

The glass pane of example 1 is used, modified in that it is provided with 21 heating strips connected in sevens to 3 separate electricity supplies connected to an electronic control box. The box is connected to an outside temperature measurement sensor (in the present case the temperature of the air is equal to that of the glass) and to 3 glass surface temperature measurement sensors, the letter being located on the face of the glass pane bearing the screen-printed wires, close to the collector powering each of the upper, median and lower heating groups (a single sensor per group). The box is programmed to match a minimum heating time to the measured outside temperature, this time having been previously determined experimentally on the glass pane covered with a layer of ice (formed under the conditions of comparative example 2) at different temperatures (varying from −20° C. to 0° C.).

The glass pane covered with a layer of ice obtained under the conditions of comparative example 2 is placed at −20° C., and the 3 groups of wires are powered sequentially, the dissipated power being equal to 150 W. The first group (upper; relative area: 31%) is heated for 335 seconds, the second group (median; relative area 33%) for 357 seconds and the third group (lower; relative area: 36%) for 389 seconds.

With the power indicated, approximately a third of the surface area of the glass pane is completely cleared in less than 6 minutes, and the complete deicing of the glass pane is achieved at the end of 18 minutes. Compared to the glass pane according to the prior art heated over its whole surface (comparative example 2), the glass pane according to the invention enables a power gain of 30%.

The glass panes according to the invention are especially usable in the motor vehicle sector.

What is claimed as new and desired to be secured by Letters Patent of the United States is:

1. A glass pane comprising at least a glass sheet provided with heating strips powered by collectors, the heating strips being divided in groups, the power supply to the different groups being provided sequentially, each group being powered once per sequence, the supply being provided by a device equipped with means enabling it to measure the outside temperature and the temperature of the outer surface of the glass, to determine a minimum heating time for each group according to said outside temperature, and to maintain the heating in said group as long as the outer surface temperature of the glass opposite said group is not higher than the melting point of ice.

2. The glass pane as claimed in claim 1, characterized in that the heating strips are isoresistant.

3. The glass pane as claimed in claim 1, characterized in that the means of measuring the temperature of the outside surface of the glass are placed on the inner face of the glass pane.

4. The glass pane as claimed in claim 1, characterized in that the heating strips are transparent layers, metal wires or screen-printed wires.

5. The glass pane as claimed in claim 1, characterized in that the heating strips are separated into at least 3 groups.

6. The glass pane as claimed in claim 1, characterized in that the minimum heating time for a given outside temperature is determined by measuring the time during which it is necessary to heat each group to completely remove a layer of ice of given characteristics.

7. The glass pane as claimed in claim 1, characterized in that an electronic unit is combined with the device for powering and switching off the collectors.

8. The glass pane as claimed in claim 1, characterized in that the electrical system powering the heating strips operates at more than 12 V, preferably at 24, 30 or 42 V or more.

9. The glass pane as claimed in claim 1, characterized in that each group is powered by its own collectors obtained by separating the collecting strips using insulators or by using several collectors.

10. The glass pane as claimed in claim 1, characterized in that heating takes place starting with the group located in the upper part of the glass pane, the groups being powered one after the other.

11. The glass pane as claimed in claim 1, characterized in that each group comprises between two and 10 heating strips, the heating strips being in parallel within each group.

12. The glass pane as claimed in claim 1, characterized in that it further includes a special antimist device.

* * * * *